US009604477B2

(12) United States Patent
Maekawa

(10) Patent No.: US 9,604,477 B2
(45) Date of Patent: Mar. 28, 2017

(54) PRINTER

(71) Applicant: SATO HOLDINGS KABUSHIKI KAISHA, Tokyo (JP)

(72) Inventor: Hitoshi Maekawa, Kanagawa (JP)

(73) Assignee: SATO HOLDINGS KABUSHIKI KAISHA (JP)

( * ) Notice: Subject to any disclaimer, the term of this patent is extended or adjusted under 35 U.S.C. 154(b) by 0 days.

(21) Appl. No.: 14/894,211

(22) PCT Filed: Apr. 25, 2014

(86) PCT No.: PCT/JP2014/061786
§ 371 (c)(1),
(2) Date: Nov. 25, 2015

(87) PCT Pub. No.: WO2014/192480
PCT Pub. Date: Dec. 4, 2014

(65) Prior Publication Data

US 2016/0129706 A1 May 12, 2016

(30) Foreign Application Priority Data

May 28, 2013 (JP) ..... 2013-111791

(51) Int. Cl.
*B41J 13/00* (2006.01)
*B41J 2/325* (2006.01)
(Continued)

(52) U.S. Cl.
CPC ..... *B41J 13/0009* (2013.01); *B41J 2/325* (2013.01); *B41J 11/0095* (2013.01); *B41J 15/042* (2013.01)

(58) Field of Classification Search
CPC .... B41J 11/003; B41J 11/0095; B41J 13/0009
See application file for complete search history.

(56) References Cited

U.S. PATENT DOCUMENTS

2007/0182807 A1* 8/2007 Sawada ..... B41J 35/18 347/213
2009/0115831 A1* 5/2009 Mochizuki ..... B41J 2/375 347/214
(Continued)

FOREIGN PATENT DOCUMENTS

JP S 59-150777 8/1984
JP 2001-071546 3/2001
(Continued)

OTHER PUBLICATIONS

International Search Report dated Jul. 22, 2014 issued in corresponding International patent application No. PCT/JP2014/061786.
(Continued)

*Primary Examiner* — Alessandro Amari
*Assistant Examiner* — Roger W Pisha, II
(74) *Attorney, Agent, or Firm* — Ostrolenk Faber LLP

(57) ABSTRACT

In order to provide a printer capable of detecting a continuous paper sheet without causing a sensor provided in the downstream side of a thermal head from being hindered by an ink ribbon, the printer includes: a main body (20) defining a conveying passage of a continuous paper sheet (P); a print unit having a thermal head (40) provided in the main body (20) to print predetermined information on the continuous paper sheet (P) by using an ink ribbon, and a platen roller (41) provided to face the thermal head (40) by interposing the continuous paper sheet (P); and a sensor unit (45) installed in the main body (20) and provided with a sensor (48) for detecting the continuous paper sheet (P), the sensor unit (45) being configured to move between a first position where the sensor (48) detects the continuous paper sheet (P) in the downstream side of the thermal head (40) and a second position farther than the first position from the thermal head (40).

7 Claims, 8 Drawing Sheets

(51) Int. Cl.
*B41J 11/00* (2006.01)
*B41J 15/04* (2006.01)

(56) References Cited

U.S. PATENT DOCUMENTS

| | | | | |
|---|---|---|---|---|
| 2012/0120143 | A1* | 5/2012 | Amit | B41J 29/38<br>347/19 |
| 2012/0236050 | A1* | 9/2012 | Sugahara | B41J 3/407<br>347/2 |

FOREIGN PATENT DOCUMENTS

| | | |
|---|---|---|
| JP | 2001-310523 | 11/2001 |
| JP | 2003-136820 | 5/2003 |
| JP | 2004-188743 | 7/2004 |
| JP | 2005-314047 | 11/2005 |
| JP | 2007-15314 | 1/2007 |
| JP | 2008-238745 | 10/2008 |

OTHER PUBLICATIONS

Written Opinion dated Jul. 22, 2014 issued in corresponding International patent application No. PCT/JP2014/061786.

* cited by examiner

PRINTER

CROSS REFERENCE TO RELATED APPLICATIONS

The present application is a 35 U.S.C. §371 National Phase conversion of PCT/JP2014/061786, filed Apr. 25, 2014, which claims benefit of Japanese Application No. 2013-111791, filed May 28, 2013,the disclosure of which is incorporated herein by reference. The PCT International Application was published in the Japanese language.

TECHNICAL FIELD

This invention relates to a printer for printing predetermined information on a print medium, and more particularly, to an effective technology applicable to a printer using an ink ribbon.

BACKGROUND ART

A printer is provided with a print unit having a print head that prints predetermined information on a print medium, and a platen roller provided to face the print bead by interposing the print medium. In addition, predetermined information is printed on the print medium by nipping a print medium between the print head and the rotating platen roller and conveying the print medium.

When the print medium is loaded on the printer, a relative position of the print medium to the print unit is detected by detecting a position mark or a gap between neighboring labels formed on the print medium by using a sensor arranged in the upstream side of the print unit.

It is noted that a sheet conveying operation of a printer has been discussed in some literatures such as JP 2005-314047 A.

CITATION LIST

Patent Literatures

[Patent Literature 1] JP 2005-314047 A

SUMMARY OF INVENTION

In order to detect a relative position of a print medium, it is necessary to cause at least a single sheet of the print medium to pass through a sensor. This results in uselessness because a single leading sheet of the print medium is conveyed to the downstream side of the print head without any printing operation.

In this regard, it is conceived that such uselessness can be removed by further providing an additional sensor for detecting the print medium in the vicinity of the downstream side of the print head, detecting the leading sheet of the print medium arriving at the downstream side of the print head by using the additional sensor, and returning the leading sheet to the print position by reversely sending the print medium by a predetermined distance to the upstream side.

Here, for example, in a printer using an ink ribbon immersed with ink, such as a heat transfer type printer or a dot impact type printer, the ink ribbon has a feeding route passing by way of the print head.

Then, if a sensor is provided in the vicinity of the downstream side of the print head as described above, a distance between the print head and the sensor is reduced so that it is difficult to cause the ink ribbon to pass through a gap between the print head and the sensor. As a result, the ink ribbon may cover the sensor as well as the print head in the traveling path.

Then, the ink ribbon is interposed between the sensor and the print medium, so that the sensor is hindered by the ink ribbon and may fail to detect the print medium.

In view of the aforementioned problems, it is therefore an object of this invention to provide a printer capable of detecting the print medium while preventing the sensor provided in the downstream side of the print head from being hindered by the ink ribbon.

According to a first aspect of the invention, there is provided a printer including: a main body defining a conveying passage of a print medium; a print unit having a print head provided in the main body to print predetermined information on the print medium by using an ink ribbon, and a platen roller provided to face the print head by interposing the print medium; and a sensor unit installed in the main body and provided with a sensor for detecting the print medium, the sensor unit being configured to move between a first position where the sensor detects the print medium in the downstream side of the print head and a second position farther than the first position from the print head.

In the printer according to a second aspect of the invention, in addition to the first aspect of the present invention, the sensor unit may be pivotable with respect to a point provided in one end of a width direction of the print head, the first position may be set to face the print head in the downstream side of the print head, and the second position may be set in a position pivoted upward with respect to the point from the first position.

In the printer according to a third aspect of the present invention, in addition to the second aspect of the present invention, the sensor unit may be provided with a rib protruding to cross a surface including a pivoting route of the sensor unit, and a stopper unit may be provided to face the rib of the sensor unit placed in the second position in the main body, the stopper unit having a first stopper that inhibits the sensor unit pivoted to the second position from being further pivoted as the rib abuts, and a second stopper that prevents the rib from going over and thus inhibits the sensor unit from returning to the first position as the rib abuts on the first stopper.

In the printer according to a fourth aspect of the present invention, in addition to the first aspect of the present invention, the sensor unit may be configured to move along a length direction of the print head, the first position may be a position where the sensor unit faces the print head in the downstream side of the print head, and the second position may be a position shifted from the first position along the length direction of the print head.

In the printer according to a fifth aspect of the present invention, in addition to the first aspect of the present invention, the sensor unit may be configured to be lowered and elevated, the first position may be a position where the sensor unit faces the print head in the downstream side of the print head, and the second position may be higher than the first position.

In the printer according to a sixth aspect of the present invention, in addition to the second, fourth and fifth aspect of the present invention, the main body may have a lower main body provided with the platen roller and an upper main body provided with the print head and openable from or closable to the lower main body, and the sensor unit may move from the first position to the second position in response to a movement of opening the upper main body.

In the printer according to a seventh aspect of the present invention, in addition to the first aspect of the present invention, the sensor unit may be configured to move to a downstream direction of the print head, the first position may be a position where the sensor unit faces the print head in the downstream side of the print head, and the second position may be a position shifted to the downstream direction of the print head from the first position.

According to these aspects, the sensor unit having the sensor for detecting the print medium provided in the downstream side of the print head can move between the first position where the sensor detects the print medium in the downstream side of the print head and the second position farther than the first position from the print head.

As a result, when the sensor unit is placed in the first position, the print medium is detected. Meanwhile, by placing the sensor unit in the second position and mounting the ink ribbon, it is possible to cause the ink ribbon to pass through a gap between the print head and the sensor.

Therefore, the sensor provided in the downstream side of the print head can detect the print medium without being hindered by the ink ribbon.

DESCRIPTION OF EMBODIMENTS

Figure 1:
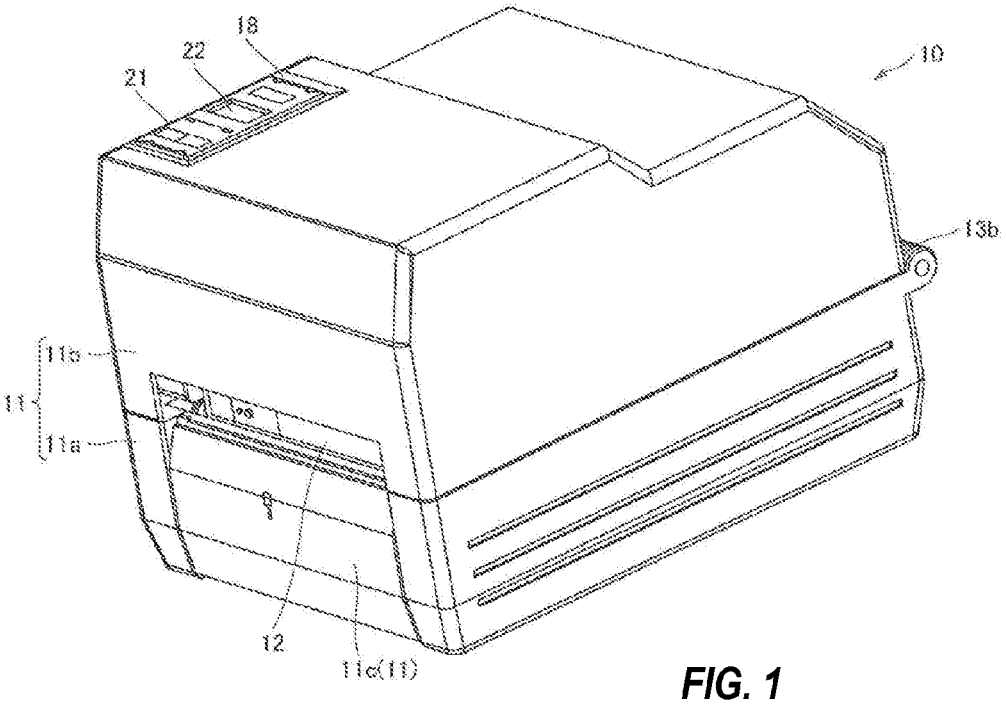
FIG. 1 is a perspective view illustrating appearance of a printer according to an embodiment of this invention.

A description will now be made for an embodiment of this invention in detail with reference to the accompanying drawings. It is noted that, in the drawings for describing the embodiments, like reference numerals denote like elements, and they will not be repeatedly described.

Figure 2:
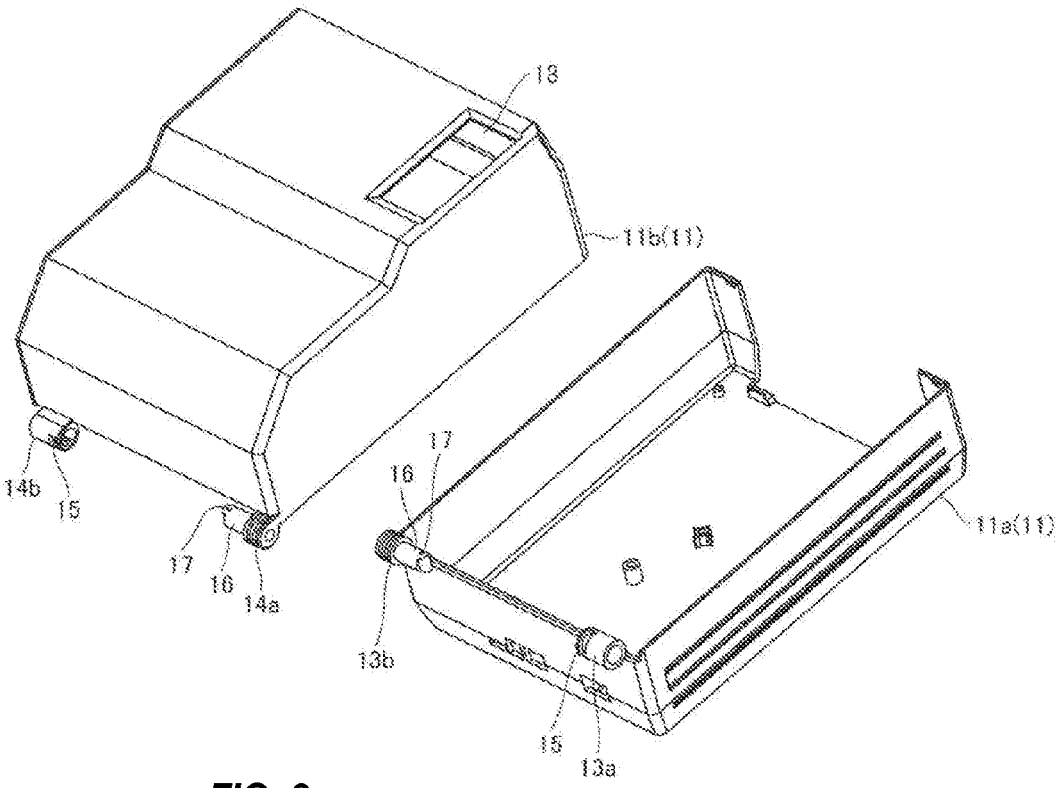
FIG. 2 is an exploded perspective view illustrating a housing of the printer of FIG. 1.
Figure 3:
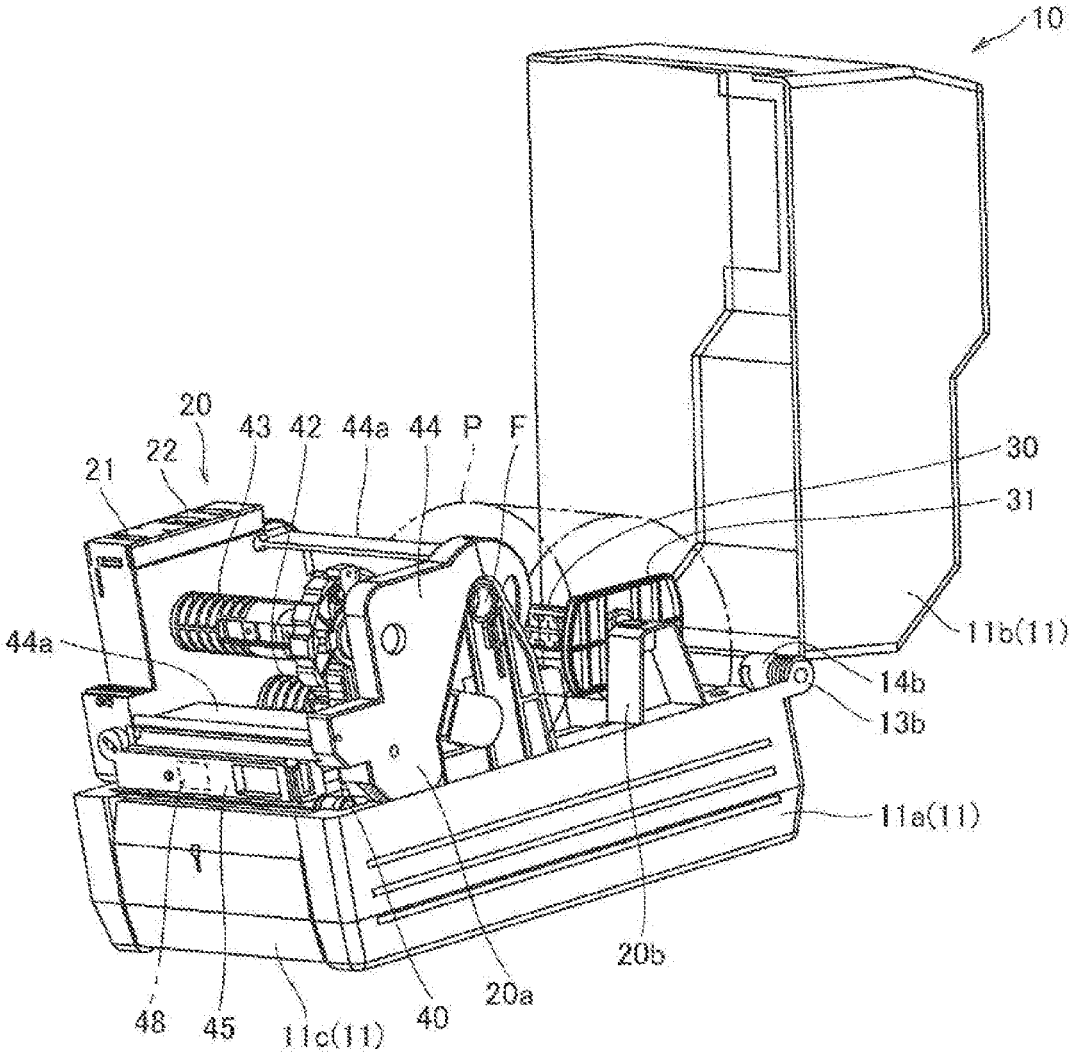
FIG. 3 is a perspective view illustrating the printer of FIG. 1 while an upper casing is opened.

As illustrated in FIGS. 1 and 2, in a printer 10 according to this embodiment, a housing 11 has a lower casing 11*a*, an upper casing 11*b* as a cover installed open/closably to the lower casing 11*a*, and a front cover 11*c* that covers an opening formed on the front face of the lower casing 11*a*. In addition, a main body 20 is housed in the housing 11 as illustrated in FIG. 3. Furthermore, a horizontally long outlet port 12 for discharging a continuous paper sheet P (print medium) printed by the main body 20 is formed on the front face of the housing 11.

As illustrated in FIG. 2, a pair of hinge portions 13*a* and 13*b* are formed integrally with the lower casing 11*a* in a rear side of the lower casing 11*a*. In addition, in the rear side of the upper casing 11*b*, a hinge portion 14*a* corresponding to the hinge portion 13*a* and a hinge portion 14*b* corresponding to the hinge portion 13*b* are formed integrally with the upper casing 11*b*.

The hinge portions 13*a* and 14*b* have a cylindrical shape extending in a horizontal direction and has a long hole 15 formed across nearly a half circle. In addition, the hinge portions 13*b* and 14*a* have protrusions 16 inserted into the hinge portions 14*b* and 13*a* having a cylindrical shape, and the leading edges of the protrusions 16 are provided with pin holes 17 visible through the long holes 15 when the hinge portions 14*b* and 13*a* are inserted.

Therefore, by sliding the lower and upper casings 11*a* and 11*b* relatively to each other in a horizontal direction to insert the hinge portion 14*a* to the hinge portion 13*a* and insert the hinge portion 13*b* to the hinge portion 14*b* and installing stopper pins (not shown) to the pin holes 17 through the long holes 15, the upper casing 11*b* is open/closably installed to the lower casing 11*a*. In addition, by causing the stopper pins to move inside the long holes 15 and abut on their one ends as the upper casing 11*b* is opened, it is possible to regulate a movable range of the upper casing 11*b*.

In FIGS. 1 and 2, a window hole 18 is provided on the upper face of the upper casing 11*b*. This window hole 18 is positioned to match an input unit 21 (unit for inputting various types of setup information such as the number of print sheets) and a display unit 22 (unit for displaying information input from the input unit) provided in the main body 20 housed in the housing 11, so that an operator can manipulate the input unit 21 and obtain information displayed on the display unit 22 by using this window hole 18.

Figure 4:
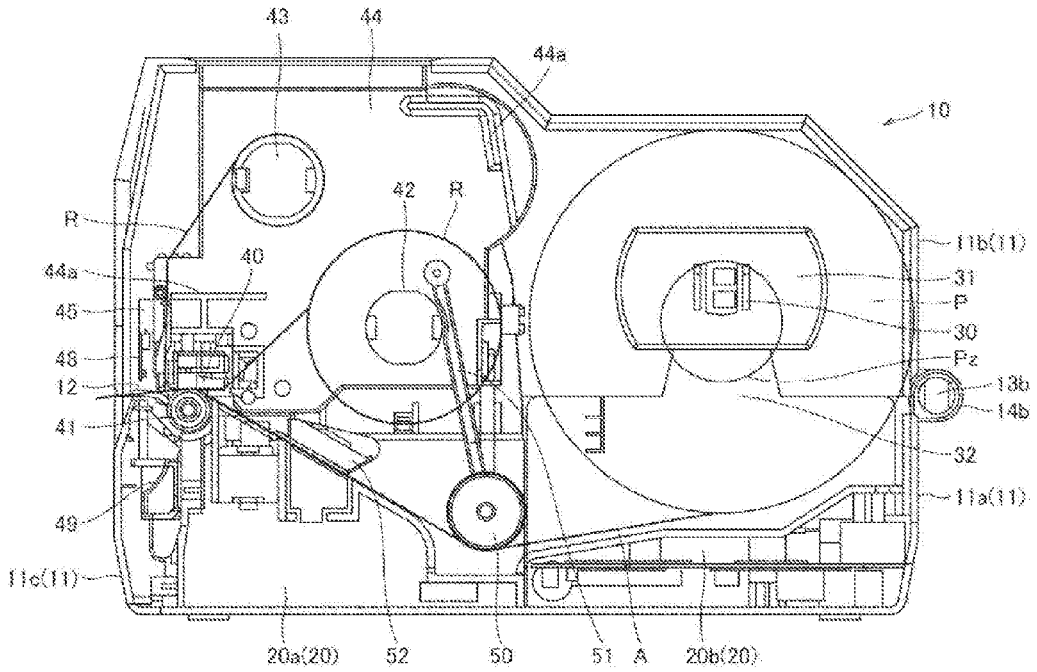
FIG. 4 is a conceptual diagram illustrating an internal structure of the printer of FIG. 1.

As illustrated in FIGS. 3 and 4, the printer 10 according to this embodiment extracts, in a sheet shape, a roll-like continuous paper sheet P having a plurality of labels temporarily attached with a predetermined interval along a longitudinal direction of a long liner having a surface applied with a releasing agent, and print predetermined information on the labels. The printer 10 has a main body 20 defining a conveying passage A of the continuous paper sheet P.

It is noted that the print medium printed by the printer 10 is not limited to the continuous paper sheet P. Instead, various other print media may also be employed, such as a tag continuous paper sheet having successive tags (labels of shipping tags or price tags) or individual label or tag pieces obtained by segmenting the label continuous paper sheet or the tag continuous paper sheet.

Figure 5:
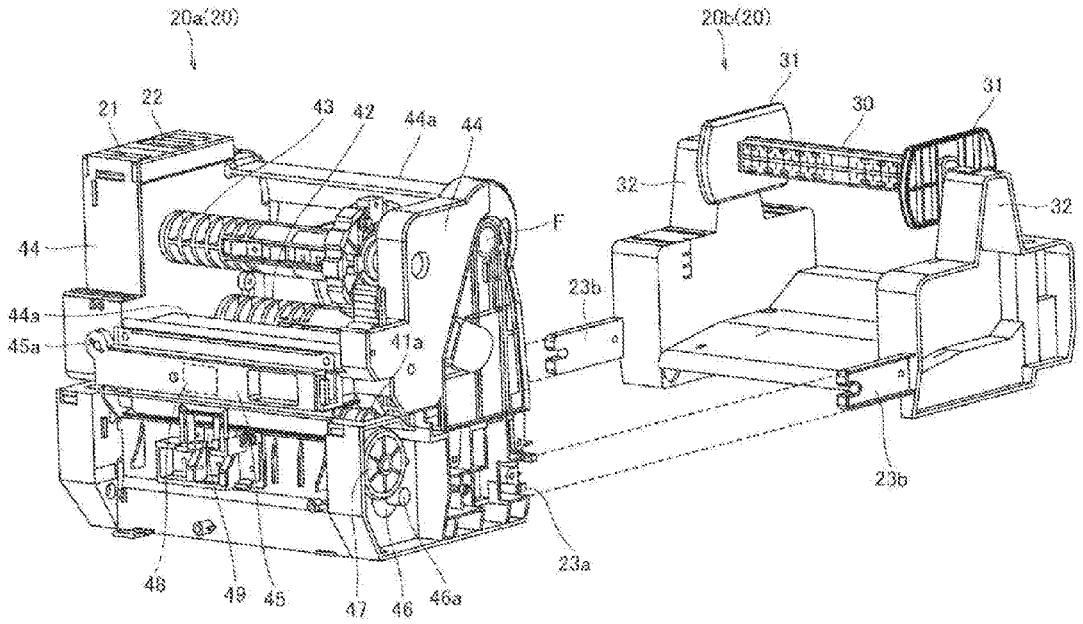
FIG. 5 is an exploded perspective view illustrating a main body of the printer of FIG. 1.
Figure 6:
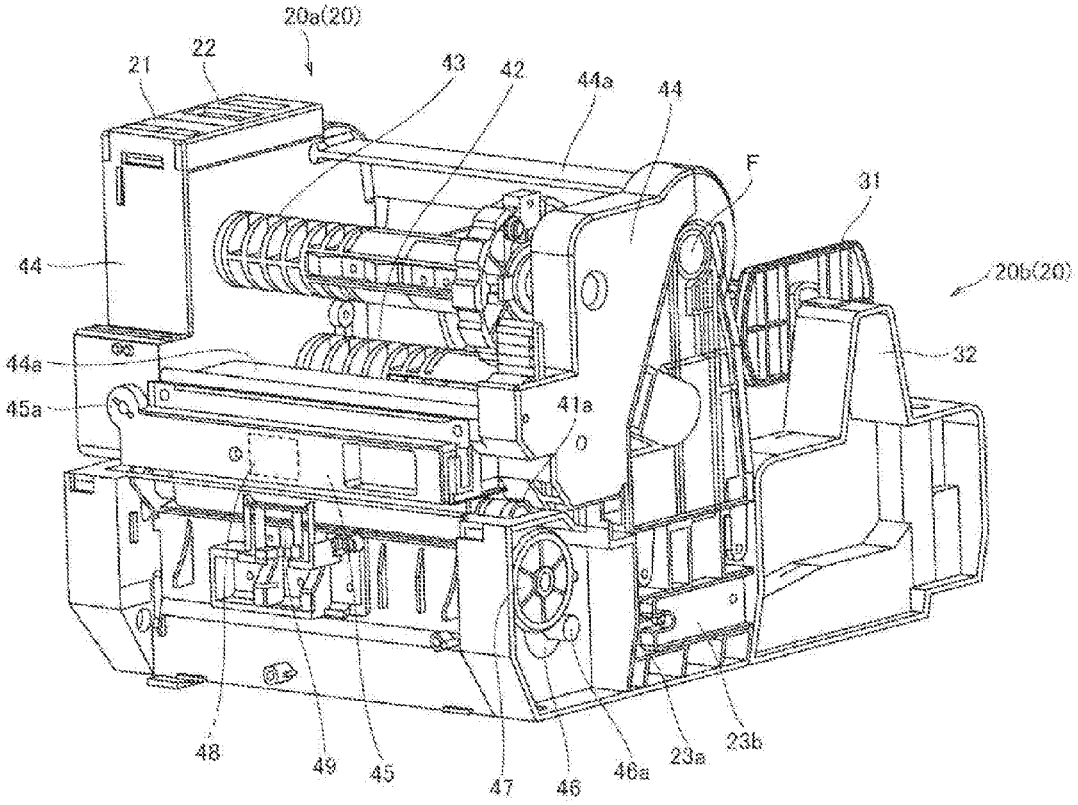
FIG. 6 is a perspective view illustrating the main body of the printer of FIG. 1.

As illustrated in FIGS. 4 and 5, the main body 20 has a print unit 20*a* that performs printing on the continuous paper sheet P and a feeding unit 20*b* that feeds the continuous paper sheet P to the print unit 20*a*. In addition, as connective concave portions 23*a* formed in both ends of the width direction of the print unit 20*a* are fitted to connective convex portions 23*b* formed in both ends of the width direction of the feeding unit 20*b* to match the connective concave portions 23*a*, the print unit 20*a* and the feeding unit 20*b* are integrally connected to each other as illustrated in FIG. 6.

In FIGS. 4 and 5, the feeding unit 20*b* has a core guide 30 that penetrates through a core PZ of the continuous paper sheet P wound around in a roll shape and rotatably supports the continuous paper sheet P, a pair of roll width regulating guides 31 slidably installed across the core guide 30 to regulate both side surfaces of the continuous paper sheet P supported by the core guide 30, and a core guide support portion 32 that supports both ends of the core guide 30.

The print unit 20*a* is provided with a thermal head 40 (print head) having a heating element and a platen roller 41 rotatably provided to face the thermal head 40. The thermal head 40 and the platen roller 41 constitute a print unit.

In addition, the print unit 20*a* is provided with a ribbon feeding shaft 42 that rotatably supports the ink ribbon R impregnated with ink and wound around in a roll shape to feed the ink ribbon R to the thermal head 40, and a ribbon winding shaft 43 that winds out the consumed ink ribbon R subjected to heat transfer of ink to the continuous paper sheet P through the thermal head 40. It is noted that the ink ribbon R extracted from the ribbon feeding shaft 42 has a traveling path going by way of the thermal head 40 and is wound around the ribbon winding shaft 43.

The platen roller 41 is formed of a hard rubber member and has a platen gear 41*a* installed in one end. The platen gear 41*a* is coupled to a driving gear 46*a* installed in a rotation shaft of the driving motor 46 by interposing a gear 47 so that the platen roller 41 is rotatably driven by the driving motor 46. In addition, the thermal head 40 is pressed toward the platen roller 41 by an elastic element (not shown) provided in the thermal head 40.

Therefore, as the platen roller 41 is rotated along with the thermal head 40 by nipping the continuous paper sheet P, the roll-like continuous paper sheet P supported by the core guide 30 is extracted and conveyed. As a result, the conveying passage A of the continuous paper sheet P is formed in the main body 20. In addition, predetermined information is printed by the thermal head 40 while the rear surface of the continuous paper sheet P is supported by the platen roller 41.

A damper roller 50 is arranged in the conveying passage A of the continuous paper sheet P where the roll-like continuous paper sheet P supported by the core guide 30 is extracted and conveyed up to the thermal head 40. The damper roller 50 is rotatably supported by a lower end of the roller suspension rod 51 via a shaft portion 50*a*, an upper end of the roller suspension rod 51 being installed in the support frame 44. As the damper roller 50 is rotated by pressing the continuous paper sheet P, the continuous paper sheet P is conveyed along the defined conveying passage A in a tensioned state without being loosened.

It is noted that, along the conveying passage A ranging from the damper roller 50 to the thermal head 40, a sensor for detecting existence of the continuous paper sheet P is embedded, and a width regulating guide 52 that regulates the width direction of the continuous paper sheet P in a proper position and guides the continuous paper sheet P to the thermal head 40 is further arranged.

The aforementioned support frame 44 is provided as a pair connected to each other with a connecting plate 44*a* arranged suitably. In addition, a pair of the support frames 44 support both ends of the thermal head 40, the platen roller 41, the ribbon feeding shaft 42, and the ribbon winding shaft 43, and the upper end of the roller suspension rod 51 opposite to the damper roller 50. It is noted that the input unit 21 and the display unit 22 described above are arranged on the upper surface of one of the support frames 44.

It is noted that the printer according to this embodiment is a heat transfer type printer using the thermal head 40 as a print head. However, a dot impact type printer may also be employed, in which fine tips corresponding to dots arranged lengthwise and breadthwise are tapped to the ink ribbon R.

In the vicinity of the downstream side of the thermal head 40 in the (print unit 20*a* of the) main body 20, a sensor unit 45 having a sensor 48 for detecting the continuous paper sheet P placed in the corresponding position is installed to face the thermal head 40 and match the traveling path of the ink ribbon R. In addition, a sensor 49 is arranged in the opposite side of the sensor 48 with respect to the continuous paper sheet P.

Here, the sensor 49 is formed from a light-emitting element, and the sensor 48 provided in the sensor unit 45 is formed from a photodetector capable of receiving light irradiated from the sensor 49. Therefore, when the continuous paper sheet P is placed between the sensors 48 and 49, the light from the sensor 49 is blocked by the continuous paper sheet P, so that the sensor 48 does not receive the light, and it is detected that the continuous paper sheet P is positioned in the downstream side of the thermal head 40. Meanwhile, when the continuous paper sheet P is not placed between the sensors 48 and 49, the light from the sensor 49 is received by the sensor 48, so that it is detected that there is no continuous paper sheet P in the downstream side of the thermal head 40.

Figure 7:
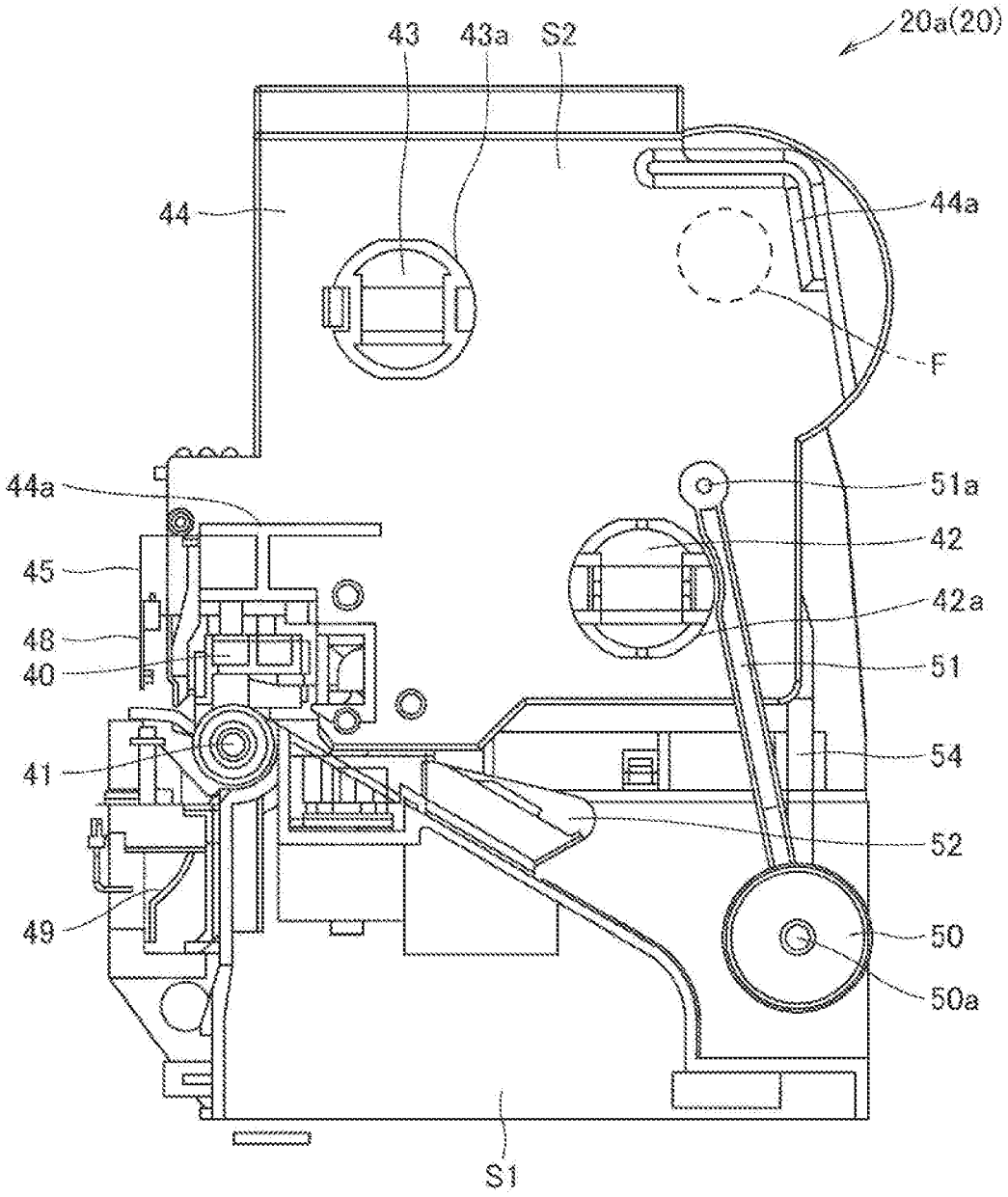
FIG. 7 is a side view illustrating a print unit of the main body of the printer of FIG. 1.
Figure 8:
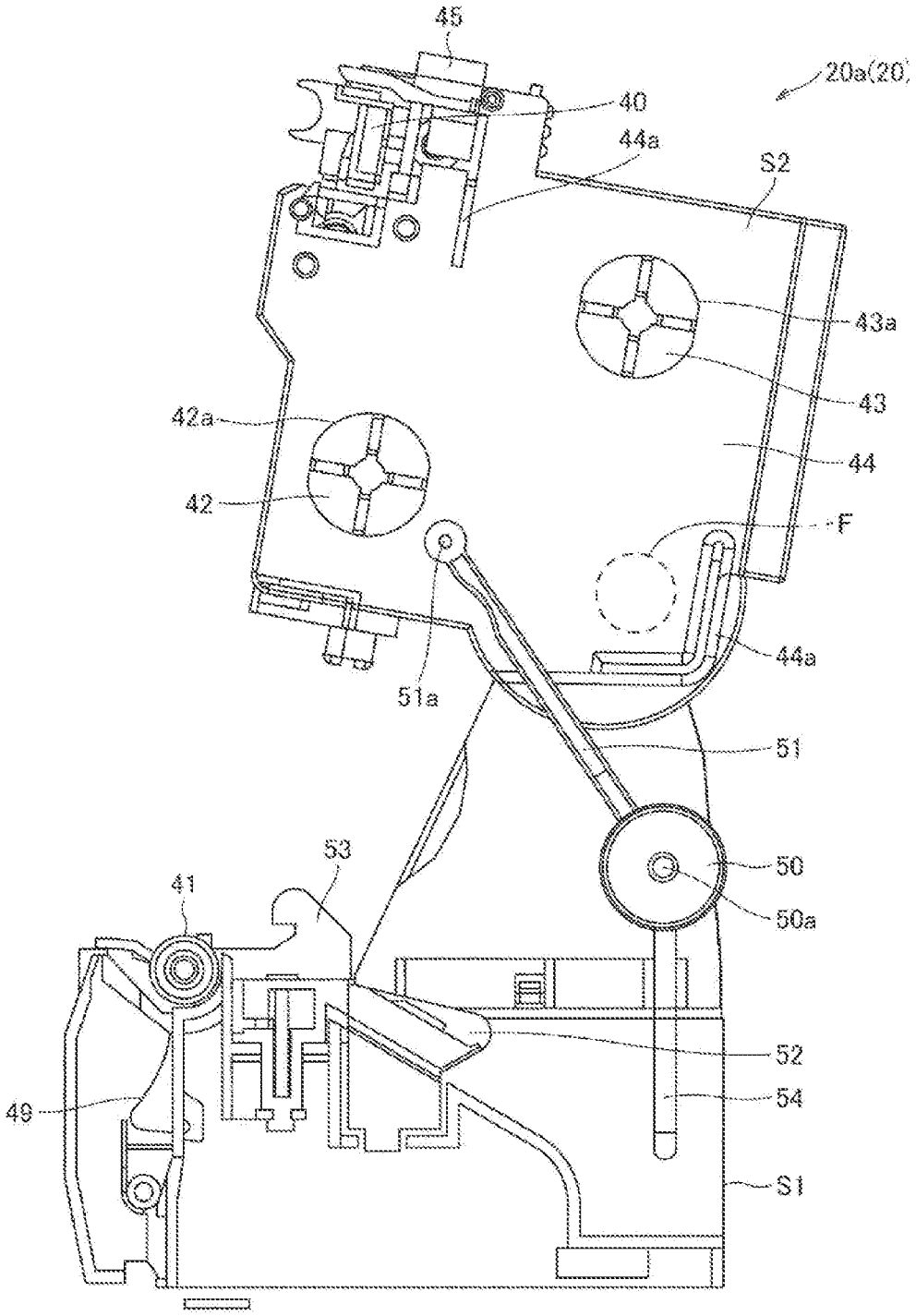
FIG. 8 is a side view illustrating an open state of the print unit of FIG. 7.

As illustrated in FIG. 7, the print unit 20*a* of the main body 20 includes a lower print unit S1 (lower main body) having the platen roller 41, and an upper print unit S2 (upper main body) having the thermal head 40 or the support frame 44. In addition, as illustrated in FIG. 8, the upper print unit S2 is installed in the lower print unit S1 by using the pivot point F and is pivoted with respect to the pivot point F so as to be opened from or closed to the lower print unit S1.

The lower print unit S1 is provided with a locking claw 53, and the upper print unit S2 is provided with a locking pin (not shown) engaged with the locking claw 53 when the print unit 20*a* is closed. In addition, when the locking pin is engaged with the locking claw 53, the upper print unit S2 is locked to the lower print unit S1 in a closed position, so that opening is prohibited. It is noted that, in order to open the upper print unit S2, the engagement between the locking pin and the locking claw 53 may be released by handling a lease lever (not shown) and pivoting the upper print unit S2 upward with respect to the pivot point F.

The lower print unit S1 has the sensor 49 or the width regulating guide 52 in addition to the platen roller 41. Furthermore, the lower print unit S1 has a long hole 54 extending in a vertical direction. The shaft portion 50*a* of the damper roller 50 is inserted into the long hole 54, so that the damper roller 50 can move vertically. It is noted that the damper roller 50 is rotatably supported by the lower end of the roller suspension rod 51 via the shaft portion 50*a* as described above.

Meanwhile, the upper print unit S2 has the ribbon feeding shaft 42, the ribbon winding shaft 43, and the sensor unit 45 having the sensor 48 in addition to the thermal head 40 and the support frame 44. In addition, the upper print unit S2 is provided with the roller support portion 51*a* that pivotably supports the upper end of the roller suspension rod 51.

It is noted that the support frame 44 is provided with shaft support portions 42*a* and 43*a* that detachably support the ribbon feeding shaft 42 and the ribbon winding shaft 43, respectively. In addition, the shaft support portion 43*a* corresponding to the ribbon winding shaft 43 is provided to be rotatable by virtue of a driving force from the motor 46 by interposing a plurality of gear trains and a transmission gear (not shown) provided in the end of the side distant from platen gear 41*a*.

As illustrated in FIG. 7, when the upper print unit S2 is closed, the damper roller 50 supported by the roller suspension rod 51 is placed under the long hole 54. In comparison, as illustrated in FIG. 8, when the upper print unit S2 is opened, the roller suspension rod 51 is pulled to the roller support portion 51*a* elevated as the upper print unit S2 is pivoted. In addition, the damper roller 50 supported by the roller suspension rod 51 moves to the upside of the long hole 54.

Therefore, when the continuous paper sheet P is set on the printer 10, the upper print unit S2 is set to the open position by opening the upper casing 11*b*, so that the damper roller 50 moves to the upside of the long hole 54. As a result, it is possible to easily cause the continuous paper sheet P to pass through a nipping portion between the thermal head 40 and the platen roller 41.

Figure 9:
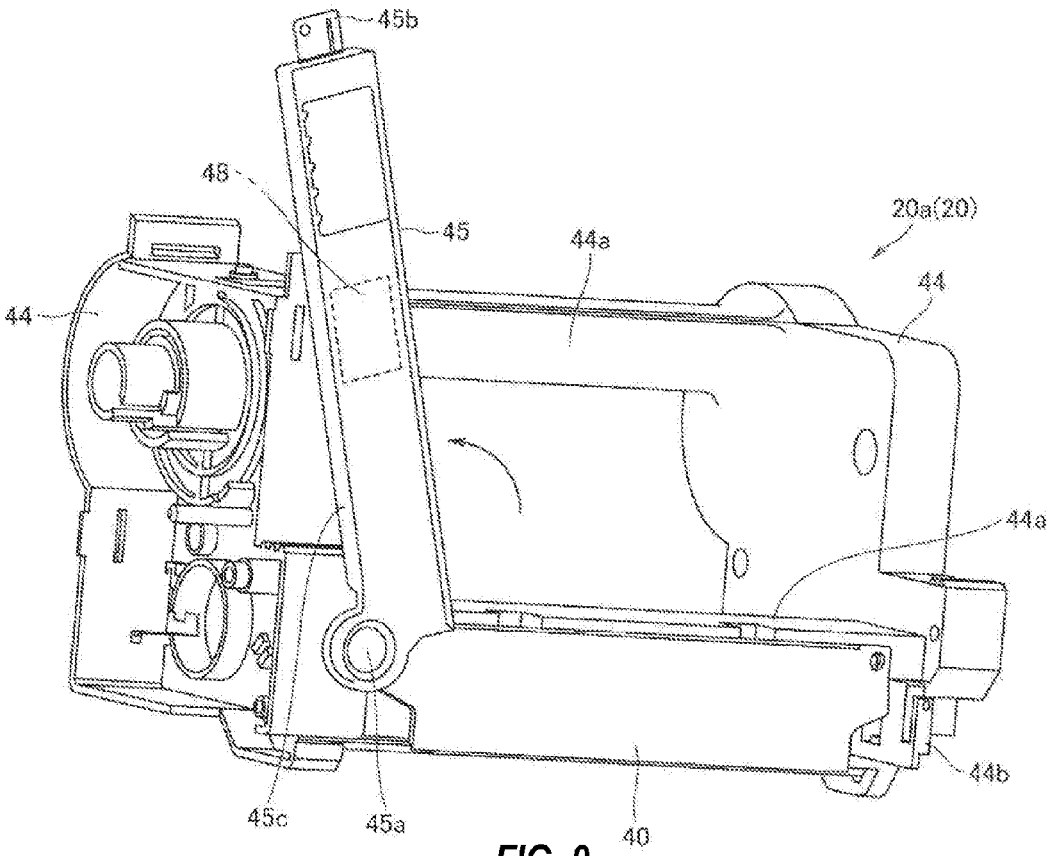
FIG. 9 is a perspective view illustrating when the sensor unit is in a second position in the print unit of the main body of the printer of FIG. 1.

As illustrated in FIG. 9, the sensor unit 45 having the sensor 48 for detecting the continuous paper sheet P in the vicinity of the downstream side of the thermal head 40 is provided pivotably upward with respect to the point 45*a* provided in one end (left end in the drawings) of the width direction of the thermal head 40.

As illustrated in FIGS. 3 to 7, in the first position where the sensor unit 45 faces the thermal head 40 so that the sensor 48 can detect the continuous paper sheet P, a holding protrusion 45*b* protruding to the opposite side of the point 45*a* of the sensor unit 45 is held by a holding portion 44*b* provided in the support frame 44.

As illustrated in FIG. 9, as the sensor unit 45 is pivoted upward with respect to the point 45*a* from the first position, the sensor unit 45 moves to the second position farther than the first position from the thermal head 40. As illustrated, in this second position, a wide space is formed in front of the thermal head 40 since the sensor unit 45 does not exist. For this reason, if the ink ribbon R is mounted by setting the sensor unit 45 in the second position as described below, it is possible to cause the ink ribbon R to pass through a gap between the thermal head 40 and the sensor 48.

Therefore, the sensor 48 provided in the downstream side of the thermal head 40 can detect the continuous paper sheet P without being hindered by the ink ribbon R.

The ink ribbon R is replaced through the following sequence.

First, the ribbon winding shaft 43 is uninstalled from the shaft support portion 43*a* of the support frame 44, and the consumed ink ribbon R wound around the ribbon winding shaft 43 is removed. Then, the ribbon winding shaft 43 is installed to the shaft support portion 43*a* of the support frame 44 again.

Subsequently, the upper print unit S2 is switched from the close position (FIG. 7) to the open position (FIG. 8), and the ribbon feeding shaft 42 is uninstalled from the shaft support portion 42*a* of the support frame 4. Then, a new ink ribbon R is set in the ribbon feeding shaft 42.

Subsequently, the sensor unit 45 is pivoted from the first position to the second position, so that the sensor unit 45 does not exist in front of the thermal head 40. In this state, a tip of the new ink ribbon R is extracted from the ribbon feeding shaft 42, is guided to the ribbon winding shaft 43 by way of the thermal head 40, and is fixed to the ribbon winding shaft 43. After the fixing, the ink ribbon R is tightened by rotating the ribbon feeding shaft 42 or the ribbon winding shaft 43.

If the ink ribbon R is installed in this manner, the sensor unit 45 is returned from the second position to the first position through pivoting (so that the ink ribbon R is interposed between the sensor unit 45 and the thermal head 40), and the upper print unit S2 is returned from the open position (FIG. 8) to the close position (FIG. 7). As a result, replacement of the ink ribbon R is completed.

When the sensor unit 45 is placed in the first position, a gap is formed between the sensor unit 45 and the thermal head 40. This gap defines a part of the traveling path of the ink ribbon R extending from the ribbon feeding shaft 42 to the ribbon winding shaft 43.

Figure 10:
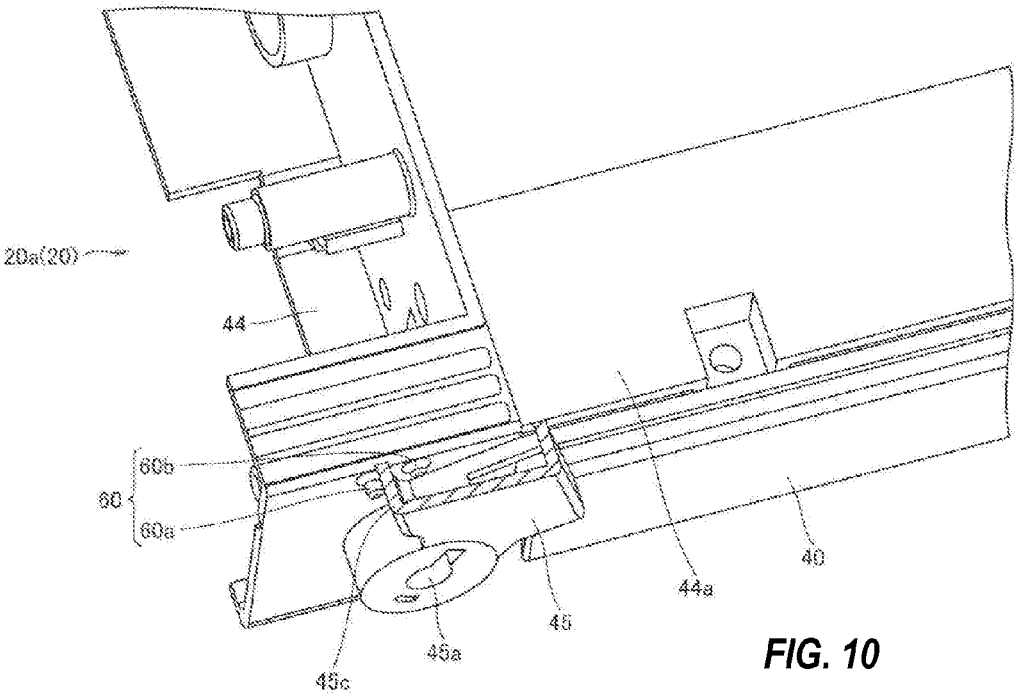
FIG. 10 is a perspective view illustrating the sensor unit placed in the second position.
Figure 11:
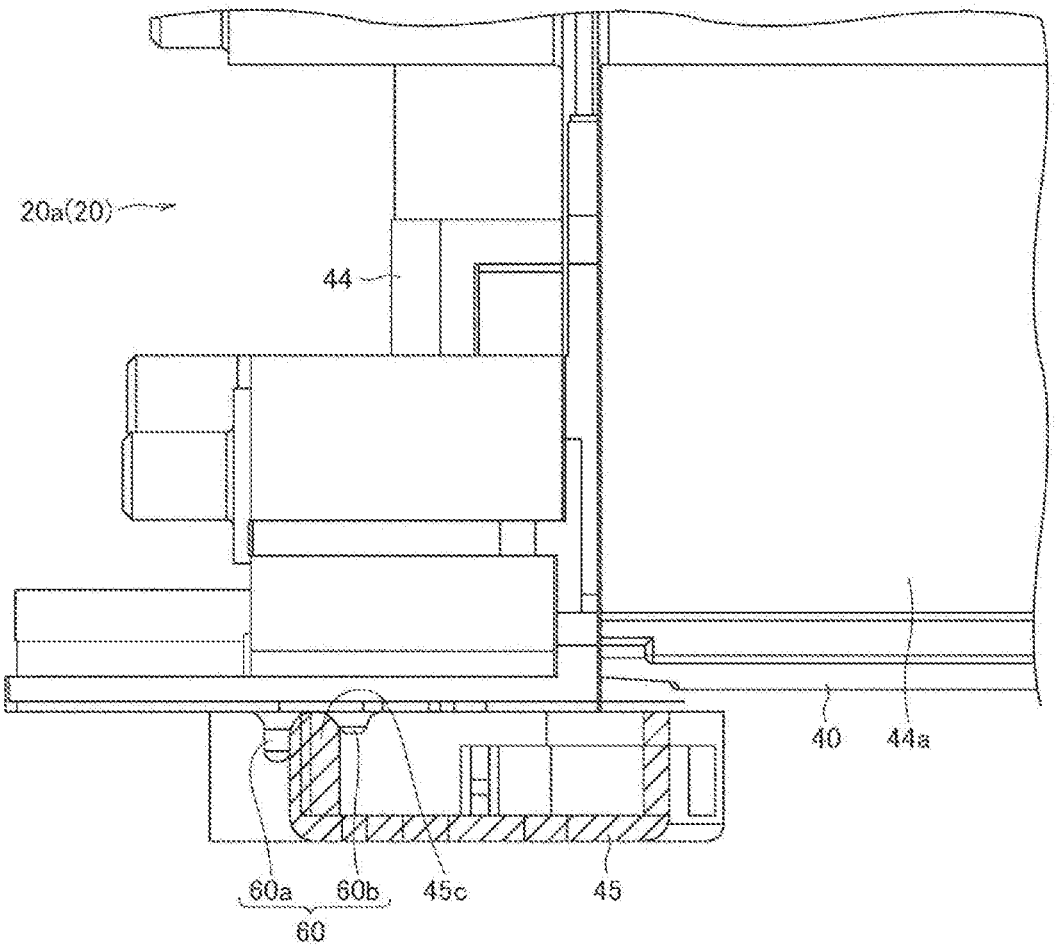
FIG. 11 is a top plan view illustrating the sensor unit of FIG. 10.

Here, as illustrated in FIGS. 10 and 11, the sensor unit 45 is provided with a resin rib 45*c* protruding to cross a surface of the pivoting route of the sensor unit 45 (the route when the sensor unit 45 is pivoted with respect to the point 45*a*).

The (print unit 20*a* of the) main body 20 is provided with a stopper unit 60 placed to face the rib 45*c* of the sensor unit 45 pivoted to the second position. The stopper unit 60 includes a first stopper 60*a* that inhibits the sensor unit 45 pivoted to the second position from being further pivoted as the rib 45*c* abuts, and a second stopper 60*b* that prevents the rib 45*c* from going over and thus inhibits the sensor unit 45 pivoted to the second position from returning to the first position as the rib 45*c* abuts on the first stopper 60*a*.

It is noted that the protruding length of the first stopper 60*a* is not limited if it can inhibit the sensor unit 45 from being further pivoted as the rib 45*c* abuts. Meanwhile, the protruding length of the second stopper 60*b* is limited because the second stopper 60*b* is required to allow the sensor unit 45 having the rib 45*c* to elastically deform and go excessively. Therefore, as illustrated, the protruding length of the first stopper 60*a* is longer than the protruding length of the second stopper 60*b*.

If the stopper unit 60 is provided in this manner, the sensor unit 45 pivoted to the second position is fixed to the second position by using the stopper unit 60. Therefore, it is possible to improve workability during replacement of the ink ribbon R.

Alternatively, according to this embodiment, the sensor unit 45 may have any movement structure if it can move between the first position where the sensor 48 can detect the continuous paper sheet P in the downstream side of the thermal head 40 and the second position farther than the first position from the thermal head 40 without limiting to the aforementioned structure in which pivoting is performed with respect to the point 45*a*. In addition, even when the sensor unit 45 moves between the first and second positions through pivoting, the aforementioned stopper unit 60 may be omitted.

Here, a description will be made for another movement structure of the sensor unit 45.

For example, the sensor unit 45 may be structured such that it can move along the length direction of the thermal head 40, the first position is set in the downstream side of the thermal head 40 to face the thermal head 40, and the second position is set in a position shifted from the first position along the length direction of the thermal head 40.

Alternatively, the sensor unit 45 may be structured such that it can be lowered and elevated, the first position is set in the downstream side of the thermal head 40 to face the thermal head 40, and the second position is higher than the first position.

In this structure, the movement of the sensor unit 45 increases. Therefore, it is possible to allow an operator to easily recognize the current position of the sensor unit 45. In addition, due to the elevating and lowering movement, even a small space is allowable to move the sensor unit.

Alternatively, the sensor unit 45 may be structured such that it can move to the downstream direction of the thermal head 40, the first position is set to the downstream side of the thermal head 40 to face the thermal head 40, and the second position is shifted to the downstream direction of the thermal head 40 from the first position.

In this structure, recognition of an operator is improved because the manipulation is performed only in the front side of the printer 10.

If the (print unit 20*a* of the) main body 20 has the lower print unit S1 and the upper print unit S2 that can be opened from or closed to the lower print unit S1 as described in this embodiment, and the sensor unit 45 is structured such that it is pivoted with respect to the point 45*a*, it is shifted along the length direction of the thermal head 40, or it is lowered or elevated, the sensor unit 45 may move from the first position to the second position in response to an opening movement of the upper print unit S2.

As a result, it is possible to omit a process of moving the sensor unit 45 to the first or second position by an operator and allow an operator to mount the ink ribbon R without minding the sensor unit 45.

While the embodiments of the invention embodied by the inventors have been described hereinbefore specifically, it should be appreciated that the embodiments disclosed herein are just for illustrative purposes and are not intended to limit the scope of the invention. Naturally, the technical scope of this invention should not be interpreted in a restrictive sense based on the description of the embodiment. Instead, the broadest interpretation should be made based on the appended claims. Therefore, the scope of the invention should be construed by the appended claims and their equivalents, and various other changes or modifications may be possible without departing from the spirit and scope of the invention.

For example, although a transparent type photodetector is employed as the sensors 48 and 49 in this embodiment, a reflection type photodetector may be employed as the sensor 48 of the sensor unit 45, and the sensor 49 may be omitted, so that existence of the continuous paper sheet P is detected by using reflection light.

Alternatively, instead of such an optical sensor, a mechanical sensor capable of detecting existence of the continuous paper sheet P based on a physical contact may also be employed.

Alternatively, the sensors 48 and 49 are not necessarily operated to remove uselessness of the print medium such as the continuous paper sheet P. Instead, they may have only a function of detecting the print medium in the downstream side of the thermal head 40, i.e., the print head.

As described above, this invention is applied to a stand-alone type printer not connected to a personal computer (PC) but provided with the input unit. However, this invention may also be applied to an online type printer connected to a PC whereby necessary input manipulations are performed.

REFERENCE SIGNS AND NUMERALS

10 printer
11 housing
11*a* lower casing
11*b* upper casing
11*c* front cover
12 outlet port
13*a*, 13*b*, 14*a*, 14*b* hinge portion
15 long hole
16 protrusion
17 pin hole
18 window hole
20 main body
20*a* print unit
20*b* feeding unit
21 input unit
22 display unit
23*a* connective concave portion
23*b* connective convex portion
30 core guide
31 roll width regulating guide
32 core guide support portion
40 thermal head
41 platen roller
41*a* platen gear
42 ribbon feeding shaft
43 ribbon winding shaft
43 locking claw
44 support frame
44*a* connecting plate
44*b* holding portion
45 sensor unit
45*a* point
45*b* holding protrusion
45*c* rib
46 driving motor
46*a* driving gear
47 gear
48 sensor
49 sensor
50 damper roller
50*a* shaft portion
51 roller suspension rod
51*a* roller support portion
52 width regulating guide
53 locking claw
54 long hole
60 stopper unit
60*a* first stopper
60*b* second stopper
A conveying passage
F pivot point
P continuous paper sheet
R ink ribbon
S1 lower print unit
S2 upper print unit

The invention claimed is:

1. A printer with an ink ribbon for printing on a print medium, the printer comprising:

a main body defining a conveying passage of a print medium;

a print unit comprising a print head provided in the main body and configured to print predetermined information on the print medium by using the ink ribbon, and a platen roller provided to face the print head by interposing the print medium; and a sensor unit installed in the main body and comprising a sensor configured to detect the print medium, the sensor unit being configured to move between a first position, where the sensor detects the print medium in a downstream side of the print head, and a second position farther than the first position from the print head, wherein the sensor unit is pivotable with respect to a point provided in one end of a width direction of the print head, the sensor unit in the first position is set to face the print head in the downstream side of the print head, and the sensor unit in the second position is set in a position pivoted upward with respect to the point from the first position.

2. The printer according to claim 1, wherein the sensor unit comprises a rib protruding to cross a surface including a pivoting route of the sensor unit, and a stopper unit is provided to face the rib of the sensor unit placed in the second position in the main body, the stopper unit comprising:

a first stopper positioned and configured to inhibit the sensor unit pivoted to the second position from being further pivoted as the rib abuts, and a second stopper that is positioned and configured to prevent the rib from going over and thus to inhibit the sensor unit from returning to the first position as the rib abuts on the first stopper.

3. The printer according to claim 1, wherein the main body comprises:

a lower main body provided with the platen roller, and an upper main body provided with the print head and openable from or closable to the lower main body, and the sensor unit is configured to move from the first position to the second position in response to a movement of opening the upper main body.

4. The printer according to claim 1, wherein a gap is formed between the sensor unit and the print head when the sensor unit is placed in the first position, the gap defining a part of a traveling path of the ink ribbon.

5. A printer with an ink ribbon for printing on a print medium, the printer comprising:

a main body defining a conveying passage of the print medium;

a print unit comprising a print head provided in the main body and positioned and configured to print predetermined information on the print medium by using the ink ribbon, and a platen roller provided to face the print head by interposing the print medium; and a sensor unit installed in the main body and comprising a sensor positioned and configured to detect the print medium, the sensor unit being configured to move between a first position where the sensor detects the print medium in the downstream side of the print head and a second position farther than the first position from the print head, wherein the sensor unit is configured to be lowered and elevated, the first position is a position where the sensor unit faces the print head in the downstream side of the print head, and the second position is higher than the first position.

6. The printer according to claim 5, wherein the main body comprises:

a lower main body provided with the platen roller, and an upper main body provided with the print head and openable from or closable to the lower main body, and the sensor unit is configured to move from the first position to the second position in response to a movement of opening the upper main body.

7. The printer according to claim 5, wherein a gap is formed between the sensor unit and the print head when the sensor unit is placed in the first position, the gap defining a part of a traveling path of the ink ribbon.

* * * * *